US010724325B2

(12) United States Patent
Yousef et al.

(10) Patent No.: US 10,724,325 B2
(45) Date of Patent: Jul. 28, 2020

(54) ROTATING CONTROL DEVICE HAVING LOCKING PINS FOR LOCKING A BEARING ASSEMBLY

(71) Applicant: Nabors Drilling Technologies USA, Inc., Houston, TX (US)

(72) Inventors: Faisal Yousef, Houston, TX (US); Tommy Vu, Houston, TX (US); Brian Ellis, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 16/054,984

(22) Filed: Aug. 3, 2018

(65) Prior Publication Data

US 2020/0040690 A1 Feb. 6, 2020

(51) Int. Cl.

| | |
|---|---|
| ***E21B 33/08*** | (2006.01) |
| ***E21B 33/06*** | (2006.01) |
| ***E21B 23/02*** | (2006.01) |
| ***E21B 4/00*** | (2006.01) |
| ***E21B 21/10*** | (2006.01) |
| ***E21B 34/16*** | (2006.01) |

(52) U.S. Cl.

CPC ..... *E21B 33/085* (2013.01); *E21B 4/003* (2013.01); *E21B 23/02* (2013.01); *E21B 33/061* (2013.01); *E21B 21/106* (2013.01); *E21B 34/16* (2013.01)

(58) Field of Classification Search

CPC ..... E21B 33/085; E21B 33/061; E21B 4/003; E21B 23/02; E21B 34/16; E21B 21/106

See application file for complete search history.

(56) References Cited

U.S. PATENT DOCUMENTS

| | | | |
|---|---|---|---|
| 3,621,912 | A | 11/1971 | Woody, Jr. et al. |
| 4,363,357 | A | 12/1982 | Hunter |
| 7,165,610 | B2 | 1/2007 | Hopper |
| 7,174,956 | B2 | 2/2007 | Williams et al. |
| 7,198,098 | B2 | 4/2007 | Williams |
| 7,334,633 | B2 | 2/2008 | Williams et al. |
| 7,726,416 | B2 | 6/2010 | Williams |
| 7,766,100 | B2 | 8/2010 | Williams |
| 7,798,210 | B1 | 9/2010 | Pruitt et al. |
| 7,874,353 | B2 | 1/2011 | Williams |

(Continued)

*Primary Examiner* — James G Sayre

(57) ABSTRACT

A rotating control device (RCD) for a drilling operation comprises a housing operable with a blowout preventer, and a bearing assembly operable to be received in the housing, and operable to receive a pipe of a drill string. The RCD comprises a plurality of locking pin assemblies supported by the housing. Each locking pin assembly can comprise a movable pin operable between a locked position that locks the bearing assembly to the housing, and an unlocked position that unlocks the bearing assembly from the housing. An RCD comprises an RCD housing coupled to a blowout preventer, and a bearing assembly received within the RCD housing and comprising a lower sealing element sleeve having a perimeter channel. The system comprises a plurality of locking pin assemblies supported by the RCD housing and operable between a locked position and an unlocked position. The movable pins can be automatically biased to the locked position by elastic elements upon removing fluid pressure from the housing. Associated systems and methods are provided.

13 Claims, 8 Drawing Sheets

(56) References Cited

U.S. PATENT DOCUMENTS

| | | | | |
|---|---|---|---|---|
| 8,256,507 | B2 | 9/2012 | Williams | |
| 8,322,432 | B2 | 12/2012 | Bailey et al. | |
| 8,991,484 | B2 | 3/2015 | Riggs | |
| 9,057,239 | B2 | 6/2015 | Young | |
| 9,068,433 | B2 | 6/2015 | Bushman et al. | |
| 9,856,713 | B2 | 1/2018 | Tarique et al. | |
| 2005/0236836 | A1* | 10/2005 | Williams | E21B 33/085 285/404 |
| 2012/0013133 | A1 | 1/2012 | Rios, III et al. | |
| 2014/0238686 | A1 | 8/2014 | Boyd | |
| 2016/0123399 | A1 | 5/2016 | Arnt et al. | |
| 2016/0258239 | A1 | 9/2016 | Clark | |
| 2016/0305213 | A1 | 10/2016 | Godfrey et al. | |
| 2019/0093445 | A1* | 3/2019 | Kulkarni | E21B 33/085 |

* cited by examiner

ROTATING CONTROL DEVICE HAVING LOCKING PINS FOR LOCKING A BEARING ASSEMBLY

BACKGROUND

During drilling operations, drilling mud may be pumped into a wellbore. The drilling mud may serve several purposes, including applying a pressure on the formation, which may reduce or prevent formation fluids from entering the wellbore during drilling. The formation fluids mixed with the drilling fluid can reach the surface, resulting in a risk of fire or explosion if hydrocarbons (liquid or gas) are contained in the formation fluid. To control this risk, pressure control devices are installed at the surface of a drilling, such as one or more blowout preventers (BOPs) that can be attached onto a wellhead above the wellbore. A rotating control device (RCD) is typically attached on the top of the BOPs to divert mud/fluid, and circulate it through a choke manifold to avoid the influx of fluid reaching a drilling rig floor (as well as allowing pressure management inside the wellbore). A bearing assembly is used for purposes of controlling the pressure of fluid flow to the surface while drilling operations are conducted. The bearing assembly is typically raised by a top drive assembly and then inserted into a "bowl" of a housing of the RCD. The bearing assembly rotatably receives and seals a drill pipe during drilling operations through the wellhead. Thus, the bearing assembly acts as a seal and a bearing, as supported by the RCD housing.

After the bearing assembly is inserted into the bowl of the housing of the RCD, the RCD can be operated to "lock" a stationary housing of the bearing assembly to the RCD housing (while still allowing for the rotational components of the bearing assembly to rotate along with a rotating drill pipe). This "locking" function is typically performed with ram mechanisms coupled to the RCD housing and that are actuated to lock the bearing assembly to the RCD housing, and then actuated to unlock the bearing assembly from the RCD housing (such as when seals of the bearing assembly need to be replaced). Another type of locking mechanisms includes a clamp mechanism that is manually or hydraulically actuated to lock the bearing assembly to the RCD housing. The ram mechanism must have internal machine thread and threaded rod, and a motor to rotate the threaded rod. The rod drives the ram into the bearing assembly to lock it. This is disadvantageous because the ram mechanism must be locked manually by an operator, which is dangerous and time consuming.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
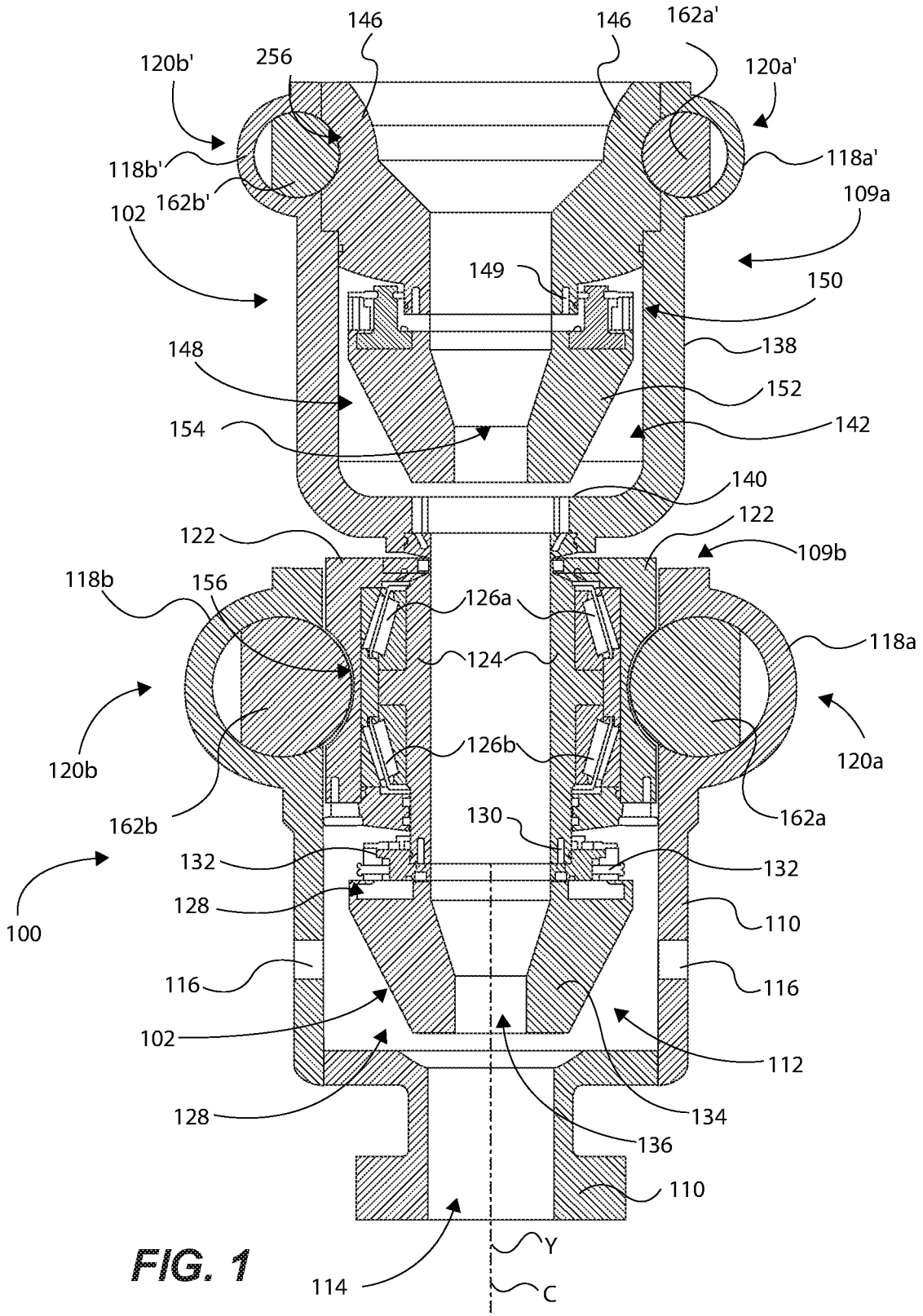
FIG. 1 is a cross-sectional view of an RCD having a bearing assembly and a locking pin system in accordance with an example of the present disclosure, and as taken along lines 1-1 in FIG. 2.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The present disclosure sets forth a rotating control device (RCD) for a drilling operation comprising a housing operable with a blowout preventer, and a bearing assembly operable to be received in the housing, and operable to receive a pipe of a drill string. The RCD can comprise a plurality of locking pin assemblies supported by the housing. Each locking pin assembly can comprise a movable pin operable between a locked position that locks the bearing assembly to the housing, and an unlocked position that unlocks the bearing assembly from the housing.

In some examples, each movable pin comprises a bearing interface surface configured to interface with a perimeter channel of a lower sealing element sleeve of the bearing assembly.

In some examples, each movable pin comprises a recessed portion, and upon moving each movable pin to the unlocked position, the recessed portion is spatially separated from the lower sealing element sleeve to facilitate removal of the bearing assembly from the housing.

In some examples, each locking pin assembly comprises at least one elastic component situated between the movable pin and the housing. The at least one elastic component can be configured to automatically bias the movable pin in the locked position.

The present disclosure further sets forth another exemplary RCD for use on a drill rig. The RCD can comprise an RCD housing coupled to a blowout preventer; a bearing assembly received within the RCD housing and comprising a lower sealing element sleeve having a perimeter channel; and a plurality of locking pin assemblies supported by the RCD housing and operable between a locked position and an unlocked position. Each locking pin assembly can comprise a movable pin operable to engage the perimeter channel of the bearing assembly to lock the bearing assembly to the RCD housing.

In some examples, each movable pin comprises a bearing assembly interface surface configured to interface with the perimeter channel of the lower sealing element sleeve, and each movable pin can be rotatable or translatable when actuated between the locked position and the unlocked position.

The present disclosure further sets forth a system for facilitating replacement of one or more sealing elements (e.g., packers) associated with an RCD. The system can comprise an RCD comprising a RCD housing coupled to a blowout preventer, and the RCD can comprise a bearing assembly received within the RCD housing and configured to receive a pipe of a drill string of the oil rig. The bearing assembly can comprise a lower sealing element sleeve; a lower sealing element coupled to the lower sealing element sleeve; a lower sealing element housing coupled to an upper sealing element sleeve; and an upper sealing element coupled to the upper sealing element sleeve. The system can comprise a plurality of lower locking pin assemblies supported by the RCD housing, and that are operable between a locked position and an unlocked position. When in the locked position, the plurality of lower locking pin assemblies lock the lower sealing element sleeve to the RCD housing, and when in the unlocked position, the bearing assembly unlocks the lower sealing element sleeve from the RCD housing to facilitate replacement of the lower sealing element. The system can comprise a plurality of upper locking pin assemblies supported by an upper sealing element housing and operable between a locked position and an unlocked position. When in the locked position, the plurality of upper locking pin assemblies lock the upper sealing element sleeve to the upper sealing element housing, and when in the unlocked position, the plurality of upper locking pin assemblies unlock the upper sealing element sleeve from the upper sealing element housing to facilitate replacement of the upper sealing element.

The present disclosure still further sets forth a method for operating an RCD for a drilling operation. The method can comprise identifying an RCD coupled to a blowout preventer of a drill rig. The RCD can comprise an RCD housing operable with the blowout preventer, and a bearing assembly receivable into the RCD housing and operable to receive a pipe of a drill string. The RCD can comprise a plurality of locking pin assemblies supported by the RCD housing, and each locking pin assembly can have a movable pin. The method can comprise applying an actuation force to the movable pins of the plurality of locking pin assemblies to be in an unlocked position. Each moveable pin is caused to be displaced in a direction so as to compress the respective at least one elastic component. The method can comprise inserting the bearing assembly into the RCD housing, and facilitating moving the movable pins from the unlocked position to a locked position, wherein the moveable pins interface with and engage the bearing assembly.

In some examples, the method comprises removing fluid pressure from fluid pressure chambers of the housing to cause each movable pin to automatically move to the locked position via a biasing force (e.g., a spring force, or a force exerted by a spring or other similar component) exerted on the movable pins via respective elastic components coupled to each movable pin.

To further describe the present technology, examples are now provided with reference to the figures.

Figure 2:
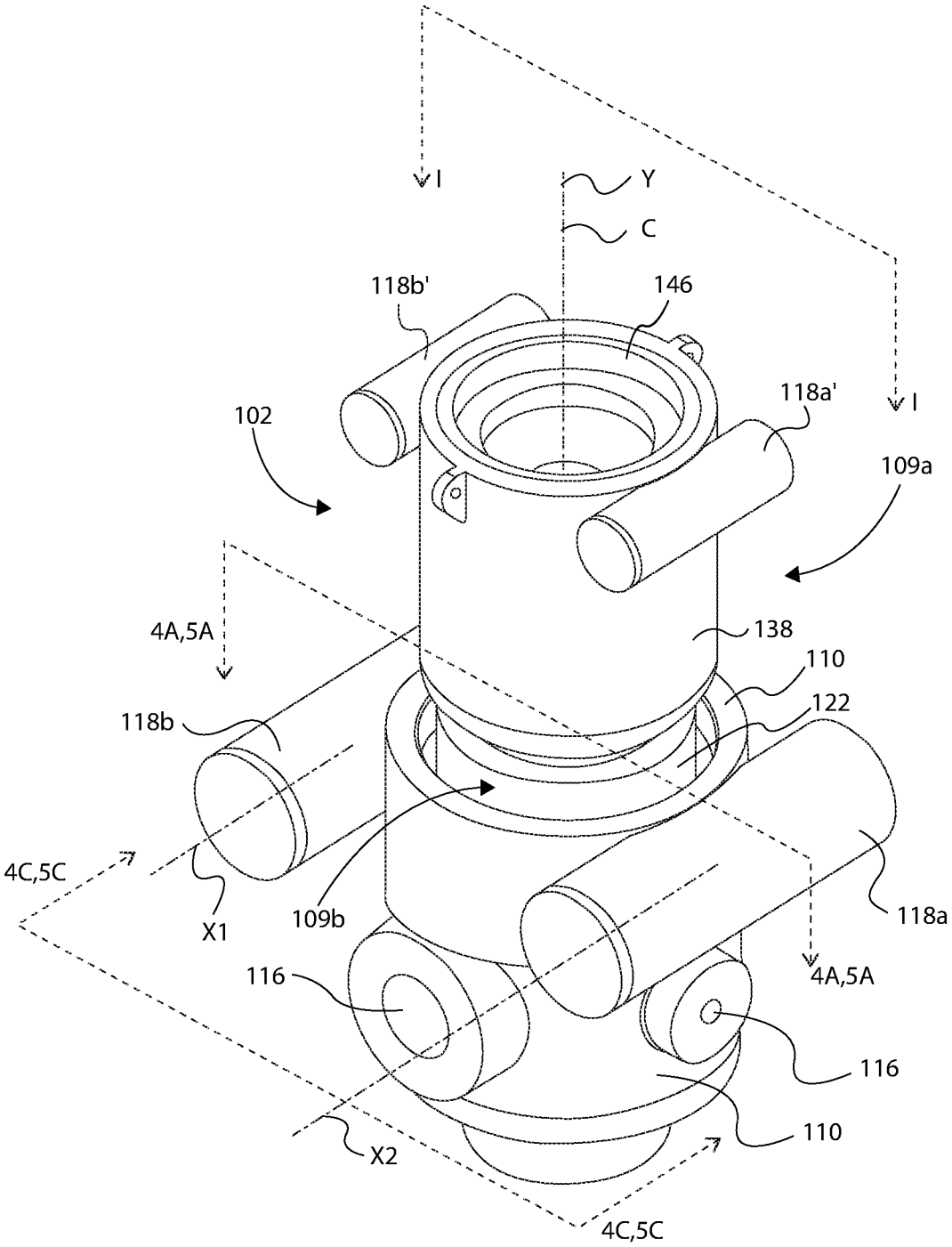
FIG. 2 is an isometric view of the locking pin system of the RCD of FIG. 1.
Figure 3:
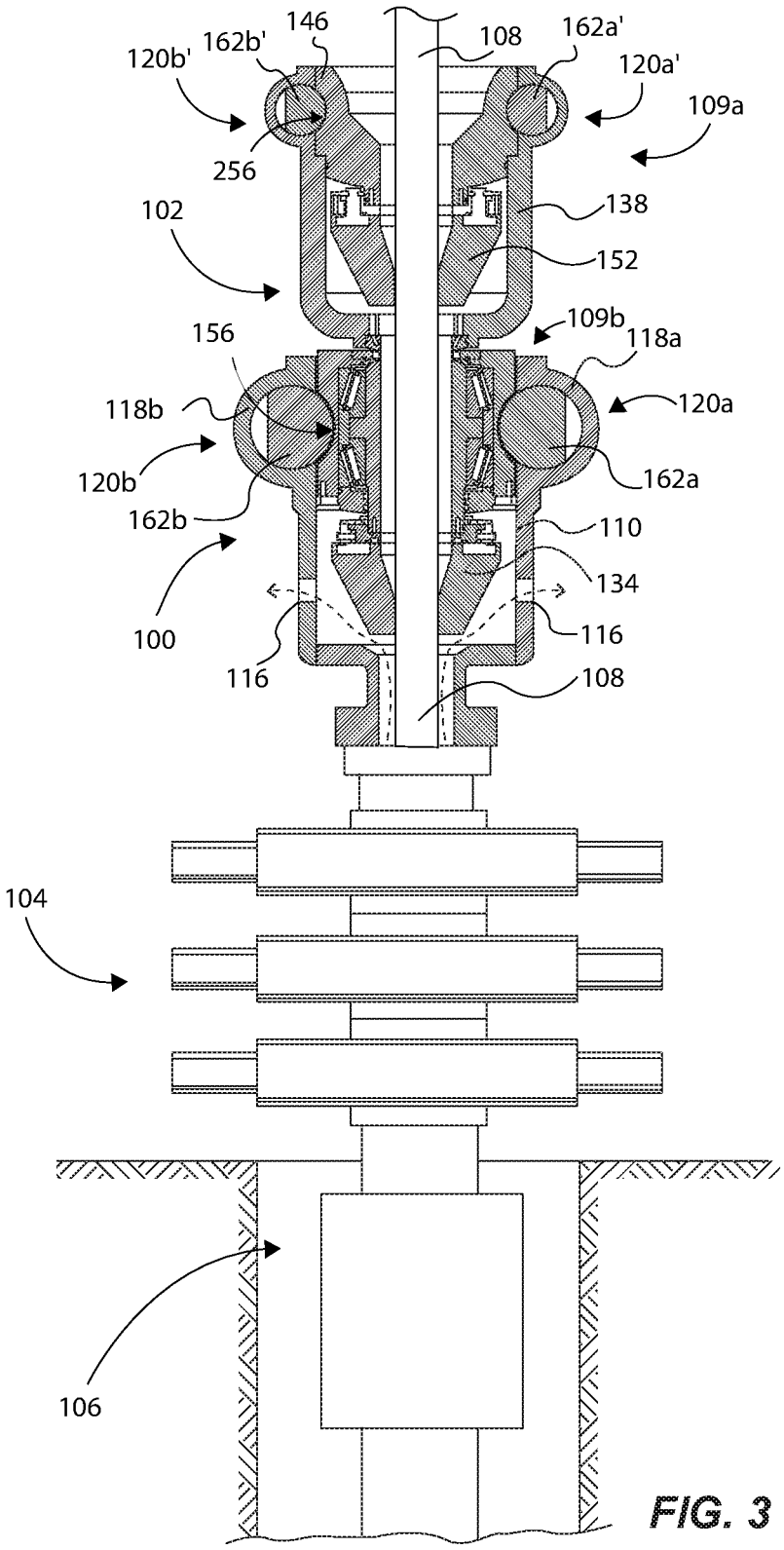
FIG. 3 is a cross-sectional view of the locking pin system of the RCD of FIG. 1, taken along lines 1-1 in FIG. 2, with the RCD and its bearing assembly shown as being coupled to BOPs operable at or with a wellbore.

FIG. 1 shows a cross-sectional view of a rotating control device (RCD) 100 having a bearing assembly 102, and FIG. 2 shows an isometric view of the RCD 100 and its bearing assembly 102. FIG. 3 shows a cross-sectional view of the RCD 100 and its bearing assembly 102 coupled to BOPs 104 of a wellbore 106. As illustrated in FIG. 3, the RCD 100 is attached on the top of and operable with the stack of BOPs 104 to divert mud/fluid away from a rig floor. The bearing assembly 102 can be used for purposes of controlling the pressure of fluid flow to the surface while drilling operations are conducted. The bearing assembly 102 can be operable with and raised by a top drive assembly (not shown) (or other means) and then inserted into the an RCD housing 110 of the RCD 100 in a manner such that the bearing assembly 102 can receive and seal a drill pipe 108 during drilling operations. Thus, the bearing assembly 102 acts as a seal and a bearing, as supported by and locked to the RCD housing 110, during drilling operations.

With reference to FIGS. 1 and 2, the bearing assembly 102 can comprise an upper sealing assembly 109*a* and a lower bearing assembly 109*b* coupled to or otherwise secured to each other. The RCD housing 110 (i.e., RCD housing) is configured to be coupled to the BOP 104 (FIG. 3). The housing 110 comprises a bowl area 112 sized to receive the lower bearing assembly 109*b* of the bearing assembly 102. The housing 110 comprises a lower opening 114 through which the drill pipe 108 loosely passes through to the BOPs 104. The housing 110 further comprises a plurality of side openings 116 through which mud/fluid can be diverted to other systems during drilling operations.

The housing 110 can comprise sub-housings 118*a* and 118*b* that each support respective lower locking pin assemblies as part of a locking block system for the RCD 100 (see lower locking pin assemblies 120*a*, 120*b* in FIG. 1, with the sub-housing 118*a-c* also comprising a similar lower locking block assembly, even though not specifically shown) that are each coupled to and supported by the housing 110. As is detailed below, the locking pin system, and particularly each locking pin assembly 120*a* and 120*b*, is operable between a locked position (e.g., FIG. 4A) that locks the bearing assembly 102 to the housing 110, and an unlocked position (e.g., FIG. 4B) that unlocks the bearing assembly 102 from the housing 110. One primary purpose of unlocking (and removing) the bearing assembly 102 from the housing 110 is to replace sealing elements of the bearing assembly 102 between downhole drilling operations, as detailed below.

The bearing assembly 102 can comprise a lower sealing element sleeve 122 that rotatably supports a lower sealing element sleeve 124 via upper and lower bearing assemblies 126*a* and 126*b*. The upper and lower bearing assemblies 126*a* and 126*b* can be situated between the lower sealing element sleeve 124 and the lower sealing element sleeve 122 to rotatably support the lower sealing element sleeve 124 about the lower sealing element sleeve 122. In one example, as shown, the bearing assemblies 126*a* and 126*b* can comprise tapered bearings. It is noted that those skilled in the art will recognize that other types of bearing assemblies could be used, and incorporated between the lower sealing element sleeve 122 and the lower sealing element sleeve 124. As such, the tapered bearings shown are not intended to be limiting in any way.

A lower sealing assembly 128 can be attached to a lower end of the rotary casing 124 via fasteners 130. The lower sealing assembly 128 can comprise a lower plate lock device 132 and a lower sealing element 134 (e.g., rubber stripper/packer) removably coupled to the lower plate lock device 132. One example configuration of the lower sealing assembly 128 is further described in U.S. patent application Ser. No. 16/054,969, filed Aug. 3, 2018, which is incorporated by reference herein in its entirety. Those skilled in the art will recognize other ways for coupling the lower sealing element 134 to or about the bearing assembly 102.

The lower sealing element 134 can comprise an opening 136 sized to receive the pipe 108 (FIG. 3), wherein the lower sealing element 134 interfaces with and seals against the pipe 108 to function as a seal as the pipe 108 rotates with the lower sealing element 134, which seal prevents mud/debris from entering the bearing assembly 102 and facilitates routing of the mud/debris out the side openings 116. Thus, as the pipe 108 rotates during drilling operations, the lower sealing element 134 concurrently rotates, thereby rotating the lower sealing element sleeve 124 (as rotatably supported by the tapered bearing assemblies 126*a* and 126*b*).

In one example, as shown, the upper sealing assembly 109*a* can comprise a rotary bearing housing 138 coupled to an upper end of the lower sealing element sleeve 124 via fasteners 140. Note that the upper sealing assembly 109*a* is an optional assembly that can be coupled to the lower bearing assembly 109*b*; however, only the lower bearing assembly 109*b* may be utilized in some applications as desired. The rotary bearing housing 138 defines a bowl area 142, and supports a plurality of upper locking block assemblies 144*a* and 144*b* operable to lock and unlock an upper rotary casing 146, via a perimeter channel 256 of the upper rotary casing 146, from the rotary bearing housing 138, as further detailed below. An upper sealing assembly 148 can be coupled to a lower end of the upper rotary casing 146 via fasteners 149. The upper sealing assembly 148 can comprise an upper plate lock device 150 and an upper sealing element 152 (e.g., a rubber stripper/packer) removably coupled to the upper plate lock device 150. The configuration of the upper sealing assembly 148 is further described in U.S. patent application Ser. No. 16/054,969, filed Aug. 3, 2018, which is incorporated by reference herein in its entirety. The upper sealing element 152 can comprise an opening 154 sized and configured to receive the pipe 108, wherein the upper sealing element 152 tightly grips and seals against the pipe 108 (FIGS. 1 and 3) to act as a seal as the pipe 108 rotates along with the upper sealing element 152. Thus, as the pipe 108 rotates during drilling operations, and as the lower sealing element 134 and the lower sealing element sleeve 124 rotate, the entire upper sealing assembly 109*a* rotates (including the rotary bearing housing 146 and the upper sealing element 152). Thus, the bearing assemblies 126*a* and 126*b* also rotatably support the upper sealing assembly 109*a* via the lower sealing element sleeve 124. As can be appreciated, only the upper and lower sealing elements 152 and 134 are in contact with portions of the pipe 108 as it extends through the respective openings 136 and 154, and as the pipe 108 rotates during drilling.

When the upper and lower sealing elements 152 and 134 wear down and need to be replaced (e.g., sometimes daily), the bearing assembly 102 can be removed from the RCD housing 110 when the lower locking pin assemblies (e.g., lower locking block assemblies 120*a* and 120*b*) are in the unlocked position (discussed below). Once the bearing assembly 102 is removed, the lower sealing element 134 can be removed (via the lower plate lock device 128) and replaced with a new sealing element. Similarly, the upper sealing element sleeve 146 (and the attached upper sealing element 152) can be removed from the upper sealing element housing 138 upon moving the upper locking pin assemblies 120*a*' and 120*b*' to the unlocked position, and the upper sealing element 152 replaced with a new sealing element.

With reference to FIGS. 4A-4D, and continued reference to FIGS. 1-3, the configuration and operation of the lower locking pin assemblies 120*a* and 120*b* is discussed below in further detail (and as also applicable the upper locking pin assemblies 120*a*' and 120*b*'). Each lower locking pin assembly 120*a* and 120*b* is operable between the locked position (FIGS. 1, 4A, and 4C) that locks the bearing assembly 102 to the housing 110, and an unlocked position (FIGS. 4B and 4D) that unlocks the bearing assembly 102 from the housing 110 so that it can be removed for any given purpose.

Figure 4A:
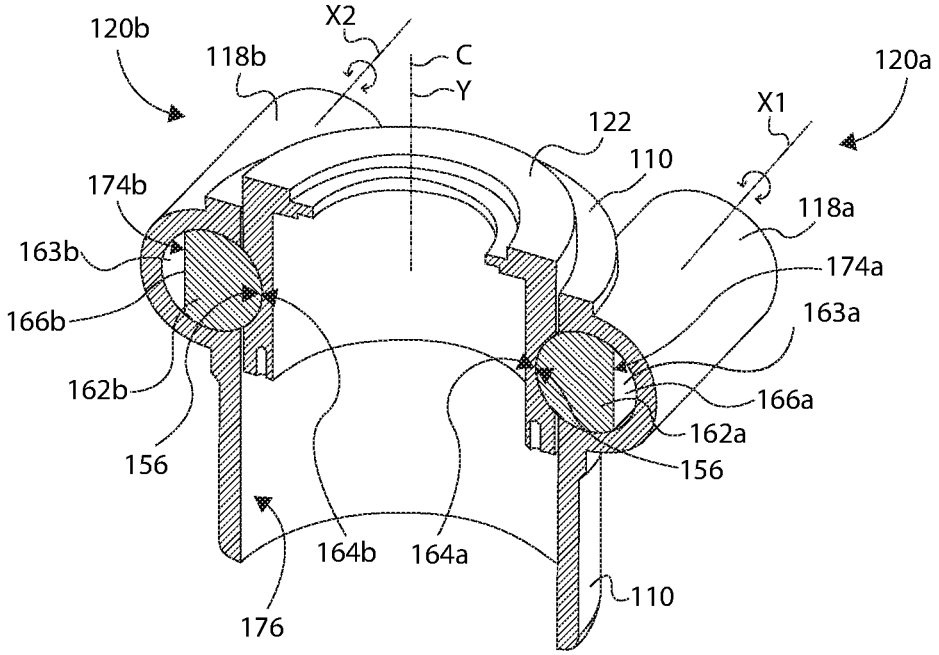
FIG. 4A is a cross-sectional view of example locking pin assemblies, in a locked position, of the locking pin system of the RCD of FIGS. 1 and 2 and as taken along lines 4A-4A of FIG. 2.

More specifically, and in one example, the lower sealing element sleeve 122 can comprise a perimeter or circumferential groove or channel 156 formed as an annular recess around the cylindrically-shaped, lower sealing element sleeve 122 (see e.g., FIGS. 1, 2 and 4A). The lower locking pin assemblies 120*a* and 120*b* can each be supported in respective sub-housings 118*a* and 118*b*, and can each comprise a movable pin (e.g., see respective movable pins 162*a* and 162*b*) rotatably supported within respective chambers 163*a* and 163*b* of the sub-housings 118*a* and 118*b*. Note that various components of the inside of the bearing assembly 102 are omitted from FIGS. 4A-4D for purposes of illustration clarity to highlight the operation of the movable pins 162*a* and 162*b*.

The movable pins 162*a* and 162*b* can comprise respective bearing interface surfaces 164*a* and 164*b* configured to interface with the perimeter channel 156 of the lower sealing element sleeve 122 when moved to the locked position. The bearing interface surfaces 164*a* and 164*b* can be curved or radial perimeter surfaces having a shape and size corresponding to the shape and size of the perimeter channel 156. This can maximize the surface-to-surface contact between the movable pins 162*a* and 162*b*, and the lower sealing element sleeve 122, to maximize a locking force that resists upward pressure from mud/fluid from below the bearing assembly 102. The movable pins 162*a* and 162*b* can comprise respective recessed portions 166*a* and 166*b* formed about a central area of the respective movable pin 162*a* and 162*b*, as further detailed below.

The movable pins 162*a* and 162*b* can each comprise respective actuation members 168*a* and 168*b* that extend from ends of the movable pins 162*a* and 162*b*. The actuation members 168*a* and 168*b* can be formed as part of the movable pins 162*a* and 162*b*, or coupled thereto in a suitable manner. In one example, respective actuation devices 170*a* and 170*b* (schematically shown) can be supported by or coupled to the respective sub-housings 118*a* and 118*b*. The actuation devices 170*a* and 170*b* can be hydraulic rotary actuators configured to rotate the respective movable pins 162*a* and 162*b* (via the actuation members 168*a* and 168*b*) clockwise and/or counter-clockwise about respective axes of rotation X1 and X2. In another example, the actuation members 168*a* and 168*b* can instead be actuation rods that extend into a portion of respective movable pins 162*a* and 162*b*, and secured thereto by suitable means, such that rotation of the actuation rods causes rotation of the movable pins 162*a* and 162*b* between the locked and unlocked positions.

Regardless of the means of rotating the movable pins 162*a* and 162*b*, in one example an actuation system, such as a hydraulic actuation system 172 (schematically shown), can be operably coupled to the actuation devices 170*a* and 170*b*. The actuation devices 170*a* and 170*b* can be part of the hydraulic actuation system 172. The hydraulic actuation system 172 can be configured to supply and remove fluid pressure to each actuation device 170*a* and 170*b* to cause rotation/actuation of the movable pins 162*a* and 162*b*, as described herein. The hydraulic system 172 can comprise a number of hydraulic valves, pumps, motors, controllers, etc., known in the art to supply and remove fluid pressure to a hydraulic actuation device to cause rotation of a member (e.g., movable pins 162*a* and 162*b*). The hydraulic system 172 can be operated manually or automatically by a computer system operable to control the hydraulic system 172 by known means of controlling hydraulic pumps and motors, such as control panels, switches, etc. In other examples, the movable pins 162*a* and 162*b* can be actuated by an electric actuator, pneumatic actuator, a screw or screw-type actuator, a manual actuator, and other such suitable actuators operable to rotate the movable pins 162*a* and 162*b*, as will be recognized by those skilled in the art.

In the example shown, each axis of rotation X1 and X2 can be generally parallel to each other because the movable pins 162*a* and 162*b* are situated generally parallel to each other as disposed on either side of the lower sealing element sleeve 122. However, the movable pins 162*a* and 162*b* can be situated at other angles relative to each other, and even three or more movable pins can be disposed around the housing 110 in a surrounding manner, and operated in a similar manner as those shown.

In some examples, each axis of rotation X1 and X2 is generally perpendicular to an axis of rotation Y of the bearing assembly 102 (FIG. 2), and also generally perpendicular to a central axis C of the housing 110. Note that the central axis C (of the RCD housing) and the axis of rotation Y (of the bearing assembly) can/should be generally collinear with each other when in the locked position.

Figure 4B:
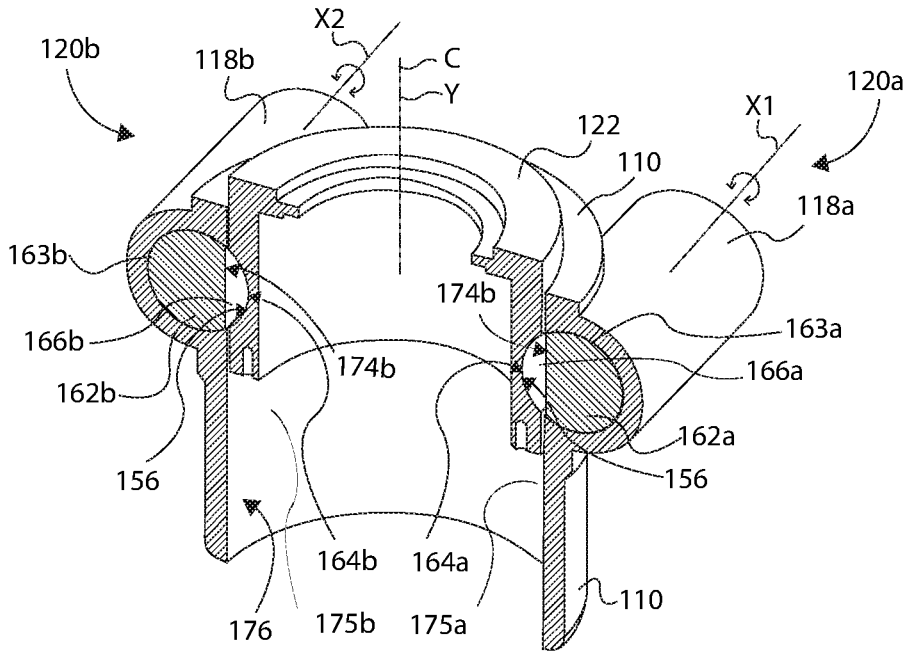
FIG. 4B is a cross-sectional view of the locking pin assemblies of FIG. 4A, and as shown in an unlocked position.
Figure 4C:
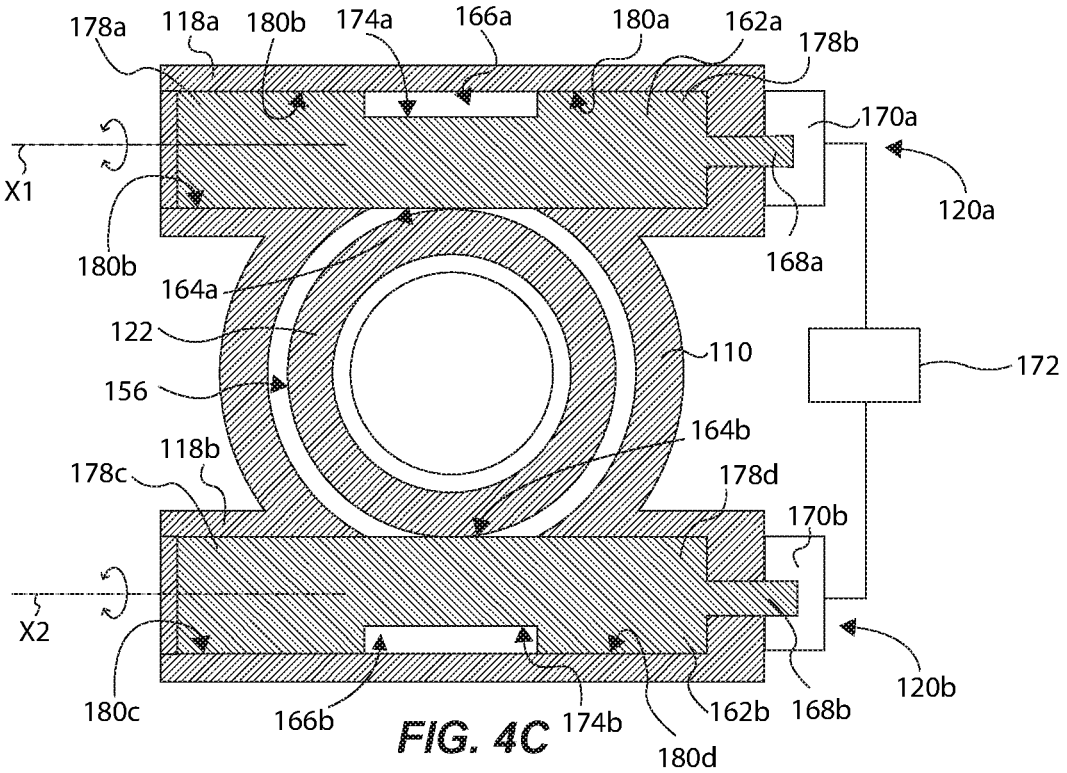
FIG. 4C is a cross-sectional view of the locking pin assemblies of the RCD of FIG. 2 taken along lines 4C-4C, and showing the locking pin assemblies in a locked position.
Figure 4D:
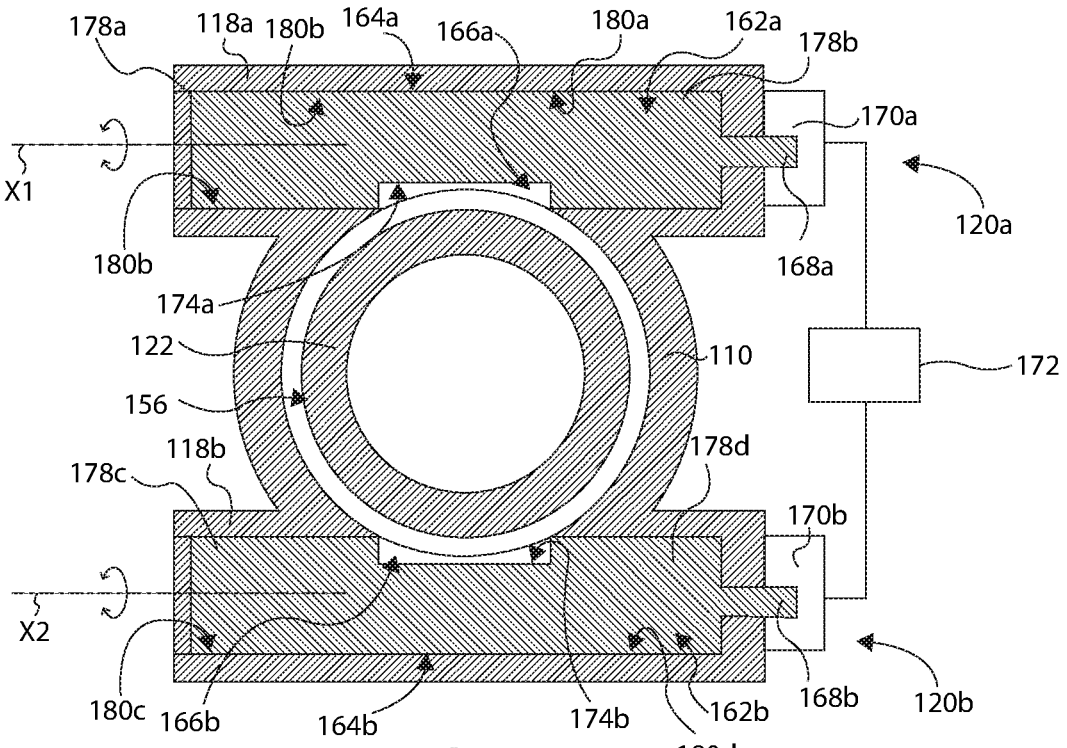
FIG. 4D is a cross-sectional view of the locking pin assemblies of the RCD of FIG. 2, with the locking assemblies being shown in an unlocked position.

As best shown in FIGS. 4C and 4D, each movable pin 162*a* and 162*b* can comprise opposing ends (e.g., ends 178*a*, 178*b* of movable pin 162*a*, and ends 178*c*, 178*d* of movable pin 162*b*) formed on either side of respective recessed portions 166*a* and 166*b*. The opposing ends 178*a-d* are each rotatably interfaced to respective inner radial walls 180*a-d* formed at either end of the respective sub-housings 118*a* and 118*b*. Thus, the respective movable pins 162*a* and 162*b* are rotatably interfaced to and supported by the respective inner radial walls 180*a-d* about the respective opposing ends 178*a-d*. This provides structural support to ends of the movable pins 162 and 162*b* so that they can be effectively actuated between the locked and unlocked positions (i.e., to prevent binding or jamming of the movable pins 162*a* and 162*b* when being actuated). This configuration also provides rigid support for the bearing assembly 102 to the housing 110 to resist the upward pressure against the bearing assembly 102 due to normal wellbore pressure during drilling.

In one example, the recessed portions 166*a* and 166*b* can each be defined by a partial-cylindrical shaped void area formed through a portion (e.g., a central area) of the movable pins 162*a* and 162*b*. Thus, the recessed portions 166*a* and 166*b* can have respective planar surfaces 174*a* and 174*b* that can extend generally vertical, relative to the axis of rotation Y of the bearing assembly 102, when in the locked and unlocked positions. Said another way, when in the unlocked position illustrated in FIG. 4B, the planar surfaces 174*a* and 174*b* are each generally vertically aligned with side wall portions 175*a* and 175*b* of an annular inner wall surface 176 of the housing 110. This provides sufficient clearance from the movable pins 162*a* and 162*b* so that the bearing assembly 102 can be removed from the housing 100 without interference from the movable pins 162*a* and 162*b*. Alternatively, the recessed portions 166*a* and 166*b* can be formed as other shapes, such as hemispherical, polygon, or other shapes to facilitate separation from the lower sealing element sleeve 156 when moved to the unlocked position.

Upon moving from the locked position (FIGS. 4A and 4C) to the unlocked position (FIGS. 4B and 4D), each movable pin 162*a* and 162*b* can be rotatably actuated a pre-determined distance. In the example shown, the movable pins 162*a* and 162*b* can be rotated approximately 180 degrees by operating the hydraulic system 172 (or other actuation system), such that the respective planar surfaces 174*a* and 174*b* of the recessed portions 166*a* and 166*b* are spatially separated from the perimeter channel 156. Accordingly, the planar surfaces 174*a* and 174*b* are generally vertically oriented and spatially separated from the side wall portions 175*a* and 175*b* of the annular inner wall surface 176 of the housing 110 (FIG. 4B). This releases a locking force from the lower sealing element sleeve 122, thereby facilitating removal of the bearing assembly 102 from the housing 110 (e.g., with a top drive hoisting upwardly the bearing assembly 102 from the housing 110).

With reference to FIGS. 5A-5D, and with continued reference to FIGS. 1-3, illustrated is another example of a housing supporting lower locking pin assemblies that can be operable with the bearing assembly 102 discussed above. Generally, each locking pin assembly 220*a* and 220*b* is operable between the locked position (FIGS. 5A and 5C) that locks the bearing assembly 102 to a housing 210, and an unlocked position (FIGS. 5B and 5D) that unlocks the bearing assembly 102 from the housing 210 so that it can be removed. Note that various components of the bearing assembly 102 are omitted from FIGS. 5A-5D for purposes of illustration clarity.

Similarly as described above with reference to FIGS. 4A-4D, the lower sealing element sleeve 122 comprises the perimeter channel 156 formed as an annular recess around the cylindrically-shaped, lower sealing element sleeve 122. The lower locking pin assemblies 220*a* and 220*b* can each be supported in respective sub-housings 218*a* and 218*b*, and can each comprise respective movable pins 262*a* and 262*b* supported within respective chambers 263*a* and 263*b* of the sub-housings 218*a* and 218*b*. Thus, the lower sealing element sleeve 122 (and the bearing assembly 102) can be used with either example of FIGS. 4A-4D and FIGS. 5A-5D. Note that the housing 210 can have the same or similar features as the housing 110 described above; however, as can be appreciated from the discussion below, and from FIGS. 5A and 5B, the housing 210 and its sub-housings 218*a* and 218*b* can be formed slightly differently to accommodate for the particular shape of the movable pins 162*a* and 162*b*.

The movable pins 262*a* and 262*b* can comprise respective first and second bearing interface surfaces 264*a* and 264*b* each configured to interface with a portion of the perimeter channel 156 on either lateral side of the lower sealing element sleeve 122 when in the locked position. The first and second radial interface surfaces 264*a* and 264*b* can be curved or circular-shaped surfaces having a shape and size corresponding to the shape and size of the perimeter channel 156. This can maximize the surface-to-surface contact between the movable pins 262*a* and 262*b*, and the lower sealing element sleeve 122, to maximize a locking force that resists upward pressure from mud/fluid from below the bearing assembly 102. The movable pins 262*a* and 262*b* can comprise respective recessed portions 266*a* and 266*b* formed about a portion (e.g., a central area) of the respective movable pins 262*a* and 262*b*. The recessed portions 266*a* and 266*b* can each be formed having a curved recessed surface 274*a* and 274*b* having a horizontal profile corresponding to the shape of the perimeter channel 156 of the lower sealing element sleeve 122. In this manner, when in the unlocked position, the recessed portions 266*a* and 266*b* are spatially separated from the perimeter channel 156 to facilitate unlocking the bearing assembly 102 from the housing 110, as shown on FIG. 5D.

The movable pins 262*a* and 262*b* can comprise respective first and second outer housing interface surfaces 267*a* and 267*b*, each having outwardly circular surfaces formed along outer surface portions of the respective movable pins 262*a* and 262*b*. The first and second outer housing interface surfaces 267*a* and 267*b* are formed opposite respective first and second bearing interface surfaces 264*a* and 246*b*. The first and second outer housing interface surfaces 267*a* and 267*b* can be slidably interfaced to corresponding inner radial walls 280*a* and 280*b* of the respective sub-housings 218*a* and 218*b*. The first and second bearing interface surfaces 264*a* and 264*b* of the movable pins 262*a* and 262*b* can be slidably interfaced to corresponding inner radial walls 283*a* and 283*b* of the respective sub-housings 218*a* and 218*b*. Note that first and second bearing interface surfaces 264*a* and 264*b* can be formed along the same side, and adjacent, the respective recessed portions 266*a* and 266*b*.

Figure 5A:
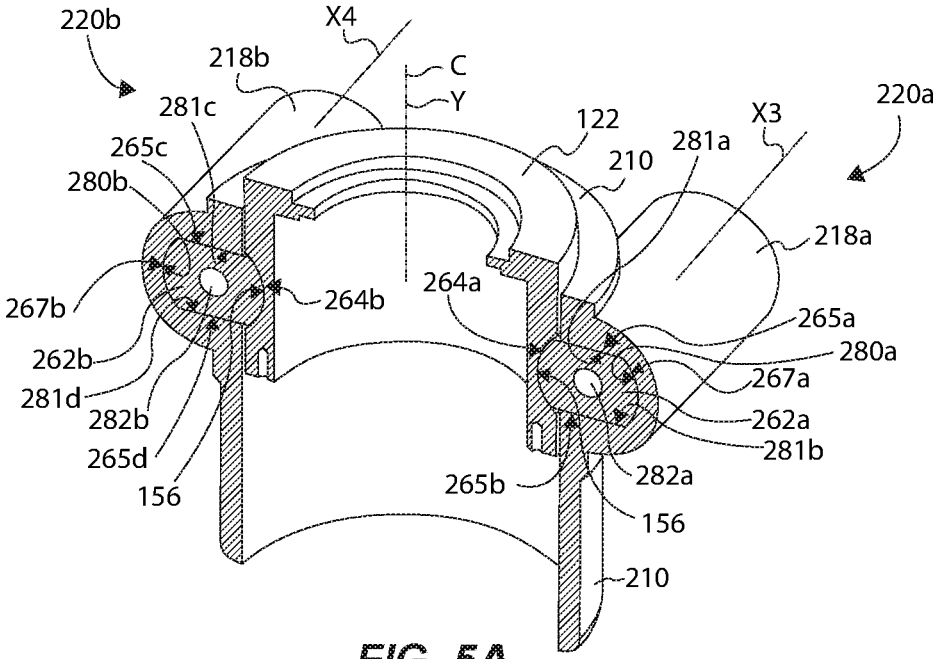
FIG. 5A is a cross-sectional view of locking pin assemblies of the locking pin system of the RCD of FIGS. 1 and 2 in accordance with another example, the locking assemblies being shown in a locked position, and as taken along lines 5A-5A of FIG. 2.
Figure 5B:
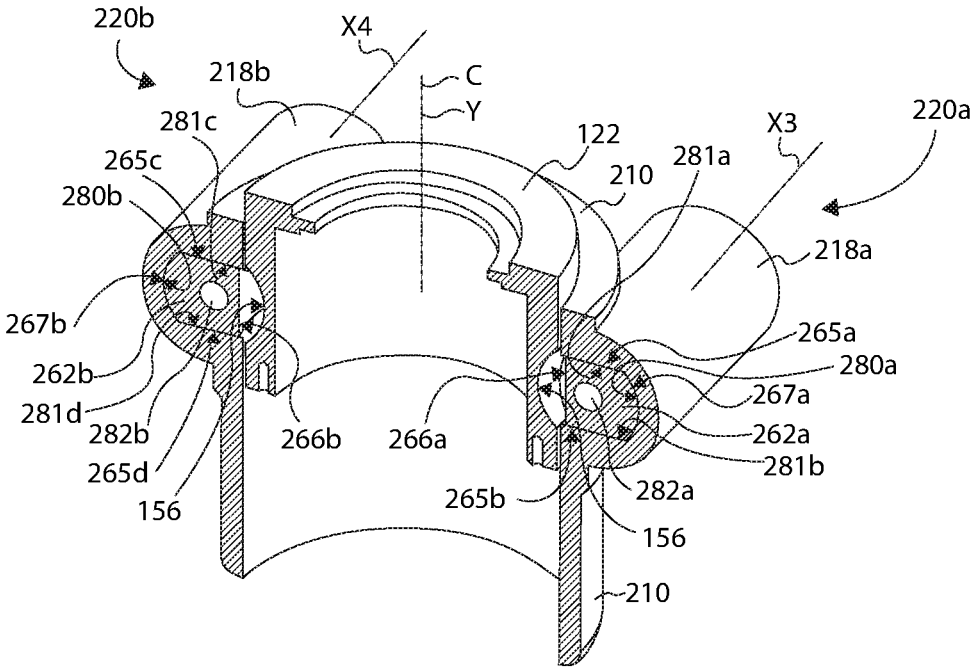
FIG. 5B is a cross-sectional view of the locking pin assemblies of FIG. 5A, taken along lines 5A-5A of FIG. 2, with the locking pin assemblies being shown in an unlocked position.

The movable pins 262*a* and 262*b* can further comprise respective upper and lower housing interface surfaces 265*a-d* (FIG. 5A), with each housing interface surface 265*a-d* having a planar surface extending longitudinally along respective upper and lower lengths of the respective movable pins 262*a* and 262*b*. The upper and lower housing interface surfaces 265*a-d* are slidably interfaced with respective upper and lower housing walls 281*a-d* of each sub-housing 218*a* and 218*b*. Thus, each movable pin 262*a* and 262*b* can have somewhat of a flattened oval cross sectional area, as best shown in FIG. 5A.

Figure 5C:
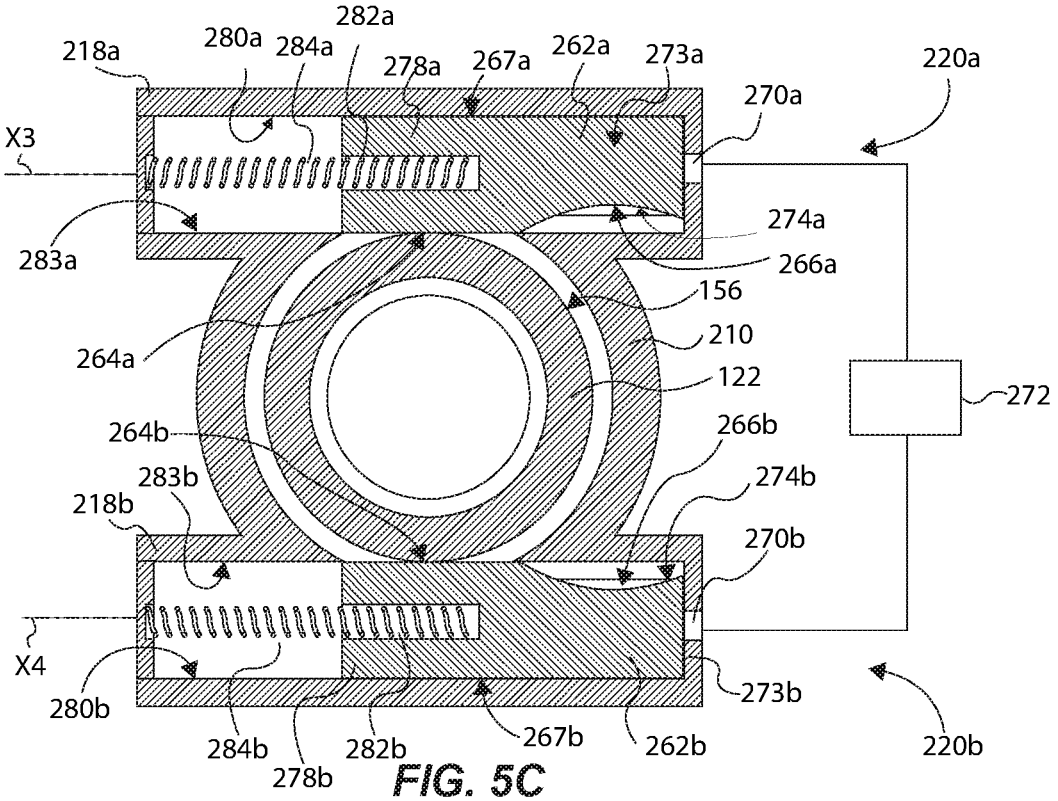
FIG. 5C is a cross-sectional view of the locking pin assemblies of FIG. 5A, and the RCD of FIG. 2, taken along lines 5C-5C of FIG. 2, and showing the locking pin assemblies in a locked position.

As shown in FIG. 5C, the movable pins 262*a* and 262*b* can comprise respective first ends 278*a* and 278*b* having respective openings 282*a* and 282*b* extending through a central area or axis of the respective movable pins 262*a* and 262*b*. Respective elastic components 284*a* and 284*b* can be disposed through, and seated within, the respective openings 282*a* and 282*b*. The other ends of the elastic components 284*a* and 284*b* can be seated in or against end portions of respective sub-housings 118*a* and 118*b*. The elastic components can comprise a spring, such as a coil or other type of spring. Thus, the elastic components 284*a* and 284*b* can be situated between respective movable pins 262*a* and 262*b* and the housings 110 in a pre-loaded spring configuration of FIG. 5A, such that the elastic components 284*a* and 284*b* automatically bias (i.e., apply a force, such as a spring force, to and in the direction of) the respective movable pins 262*a* and 262*b* in the locked position of FIG. 5A. Those skilled in the art will recognize that the elastic components can be any elastic component or element that acts in a spring-like manner, namely one that can be pre-loaded and caused to apply or exert a biasing force on the moveable pins. Example elastic components can include, but are not limited to, an elastic polymer, a compressed gas component, or a variety of other spring-like elements. In some examples, only one elastic component may be incorporated to perform the function of biasing the movable pins in the locked position.

Figure 5D:
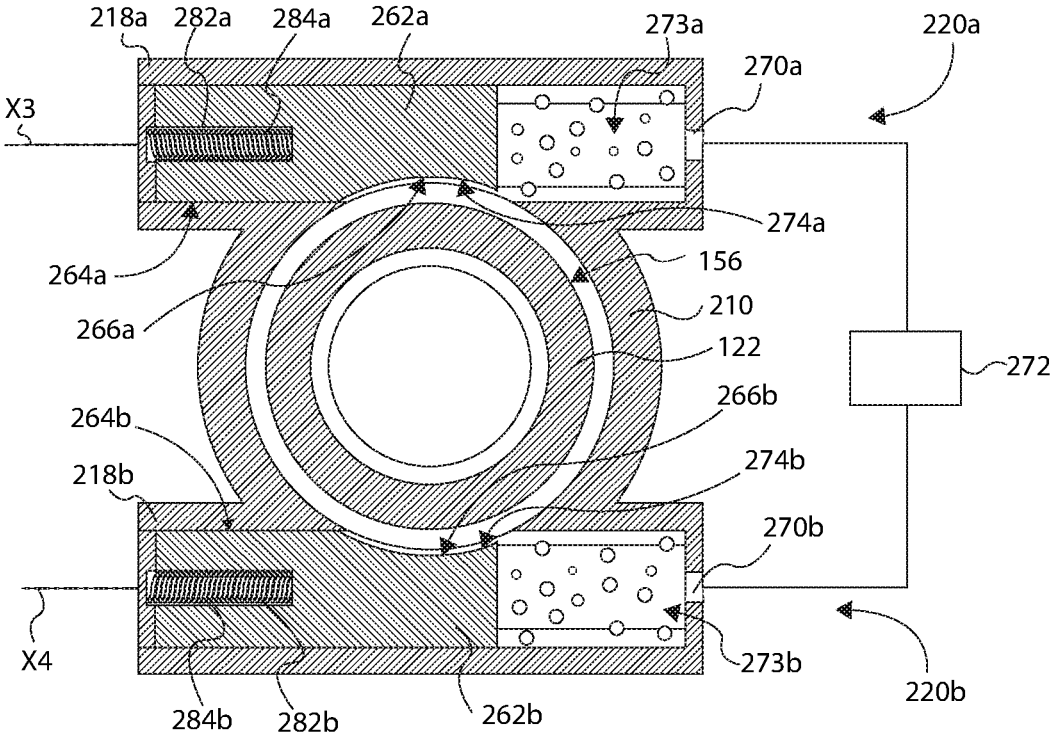
FIG. 5D is a cross-sectional view of the locking pin assemblies of FIG. 5A, and the RCD of FIG. 2, taken along lines 5C-5C of FIG. 2, and showing the locking pin assemblies in an unlocked position.

In one aspect, a fluid (hydraulic or pneumatic) system 272 (schematically shown) can be operably coupled to respective sub-housing 218*a* and 218*b* via fluid lines coupled to respective fluid ports 270*a* and 270*b* of the sub-housing 218*a* and 218*b*. The fluid ports 270*a* and 270*b* can have connectors or valves coupled to the respective sub-housing 218*a* and 218*b* adjacent ends of respective moveable pins 262*a* and 262*b*. The sub-housings 218*a* and 218*b* can each comprise a fluid pressure chamber 273*a* and 273*b* (FIG. 5D) in fluid communication with respective fluid ports 270*a* and 270*b*. Accordingly, the fluid system 272 can be configured to supply fluid pressure to the fluid pressure chambers 273*a* and 273*b* to actuate respective movable pins 262*a* and 262*b* to overcome the biasing force, and to move them from the locked position (FIG. 5C) to the unlocked position (FIG. 5D).

More specifically, when the movable pins 262*a* and 262*b* are in the locked position due to spring forces exerted by the respective elastic components 284*a* and 284*b*, fluid pressure is not supplied (or is nonexistent) to the fluid pressure chambers 273*a* and 273*b*. Upon supplying fluid pressure to the fluid pressure chambers 273*a* and 273*b* via the fluid ports 270*a* and 270*b*, an amount of actuation force due to the supplied fluid pressure becomes greater than the spring or biasing forces exerted against the movable pins 262*a* and 262*b*. In this manner, the fluid pressure supplied to the fluid pressure chambers 273*a* and 273*b* exerts a force that axially translates the movable pins 262*a* and 262*b* along respective axes of translation X3 and X4, and to the unlocked position. Accordingly, such fluid pressure overcomes the forces exerted by the elastic components 284*a* and 284*b* and causes compression of the elastic components 284*a* and 284*b*, thereby actively actuating the movable pins 262*a* and 262*b* in the unlocked position of FIG. 5D due to the supplied fluid pressure. In this unlocked position, the recessed portions

266*a* and 266*b* have been moved to positions, such that the respective curved interface surfaces 274*a* and 274*b* are spatially separated from the perimeter channel 156 of the lower sealing element sleeve 122. In this manner, the bearing assembly 102 is unlocked from the housing 110 so that it can be removed therefrom.

The fluid system 272 can comprise a number of hydraulic (or pneumatic) valves, pumps, motors, controllers, etc., known in the art to supply and remove fluid pressure about the fluid pressure chambers, and can be operated manually or automatically by a computer system operable to control the hydraulic system 272 by known means of controlling hydraulic pumps and motors. In other examples, the movable pins 262*a* and 262*b* can be actuated pneumatically by supplying compressed gas to the fluid pressure chambers 273*a* and 273*b* with sufficient gas pressure to overcome the applied spring forces. Such gas pressure can be removed so that the elastic components 284*a* and 284*b* can automatically bias the respective movable pins 262*a* and 262*b* in the locked position.

No matter the type of actuation system utilized, the movable pins 262*a* and 262*b* can "automatically" transition from the unlocked position (FIGS. 5B and 5D) to the locked position (FIGS. 5A and 5C) by virtue of the biasing spring force exerted by the elastic components 284*a* and 284*b*. This means that the kinetic energy stored in the elastic components 284*a* and 284*b* (when compressed in the unlocked position) is released upon removing fluid pressure from the fluid pressure chambers 273*a* and 273*b*, via the hydraulic system 272 for instance. Removing such fluid pressure causes or allows the elastic components 284*a* and 284*b* to expand and displace the movable pins 262*a* and 262*b* toward the other end of the respective sub-housings 218*a* and 218*b*, thereby allowing or facilitating automatic movement of the movable pins 262*a* and 262*b* to the locked position shown on FIG. 5C. Thus, there is no active actuation or external control of the movable pins 262*a* and 262*b* to cause them to move to the locked position. Advantageously, this system provides a fail-safe to help prevent injury to operators working with the bearing assembly 102 and the RCD housing 110 because the locking pin assemblies 220*a* and 220*b* are caused to be in a locked position by default, and to automatically self-lock to the bearing assembly 102 upon removing fluid pressure from the fluid pressure chamber 273*a* and 273*b*. For example, if fluid pressure is lost because of a failure of the fluid system 272, the locking pin assemblies 220*a* and 220*b* will automatically move to the locked position via the stored spring force. Moreover, there is no requirement for a human operator to manually interact with or engage the bearing assembly 102 to lock it to the RCD housing 110, which improves safety and efficiency of the system because it prevents possible injury while automating the locking function, in contrast with prior systems that are manually operated (e.g., with rams, clamps, etc.), and/or that require the system to perform an active actuation function to lock the bearing assembly. Such "automatic" locking movement of the movable pins 262*a* and 262*b* to the locked position also assists to properly align the bearing assembly 102 with the RCD housing, which is important for proper downhole drilling and to prolong the life of the bearing assembly 102. This is because, with prior, current, or existing technologies that rely on "active actuation" to lock a bearing assembly to an RCD housing (e.g., ram locks), precisely controlling the travel speed and position of the ram locks relative to each other is difficult and problematic because, in many instances, one of the ram locks may move too quickly or otherwise contact the bearing assembly before the other ram lock(s) happen to contact the bearing assembly. This can potentially misalign the bearing assembly relative to the RCD housing, which can cause the bearing assembly to rotate off-axis relative to the central axis of the RCD housing, which can cause bearings and sealing elements to wear down more rapidly. This can also damage components of the overall system in instances where the ram locks are in different lateral positions around the bearing assembly.

However, with the present technology disclosed herein, the expanding elastic components 284*a* and 284*b*, and the curve shape of the first and second bearing interface surfaces 264*a* and 264*b* tend to compensate for such possible misalignment when allowing the movable pins 262*a* and 262*b* to automatically move to the locked position. For example, if for some reason the movable pin 262*a* initially contacts the stationary bearing assembly 122 before the other movable pin 262*b* contacts the stationary bearing assembly 122, and if the bearing assembly 102 is vertically and/or laterally misaligned to the housing 110, the outward curvature of the first bearing interface surface 264*a* will slide along and self-align with the corresponding curvature of the perimeter channel 156 until the movable pin 262*a* is fully in the locked position. Such slidable interfacing can vertically and/or laterally properly position the lower sealing element sleeve 122 until such time that the other movable pin 262*b* contacts and interfaces with the perimeter channel 156 on the other side of the lower sealing element sleeve 122, which itself has a slidable interface and which can also self-align. Thus, the system can self-align the bearing assembly 102 to the housing 110 despite the speed and/or position of either movable pin 262*a* or 262*b* relative to the other.

The self-alignment features described above regarding FIGS. 4A-5D can be advantageous in the face of several potential operational situations. For example, the housing 110 of the RCD 100 may not always be properly vertically disposed as coupled to the BOPs as extending from a wellbore. Moreover, the bearing assembly 102 may not always be properly aligned with the housing 110 when the bearing assembly 102 is being inserted into the housing 110 via a top drive assembly. Still further, a large amount of spring force (i.e., regarding the system shown in FIGS. 5A-5D) can be exerted against each movable pin (e.g., 500 pounds or more), causing any one of the movable pins 262*a* and 262*b* to bind-up or jam against the lower sealing element sleeve 122 when moving the locked position, Thus, to account for these considerations, and to properly align and lock the bearing assembly 102 to the housing 110, the curved or radial bearing interface surfaces are formed about each movable pin (e.g., movable pins 162*a*, 162*b*, 262*a*, 262*b*), and a corresponding curved or radial surface is formed about the perimeter channel 156 (as further described above) in a particular manner, all to help guide and self-align the bearing assembly 102 to the housing 110 when transitioning from the unlocked position to the locked position.

As can be appreciated, for example with reference to FIG. 5A, each axis of translation X3 and X4 is generally parallel to each other because the movable pins 262*a* and 262*b* are generally situated parallel to each other on either side of the lower sealing element sleeve 122. And, each axis of translation X3 and X4 is generally perpendicular to the axis of rotation Y of the bearing assembly 102, and generally perpendicular to the central axis C of the housing 110 (e.g., with a top drive hoisting upwardly the bearing assembly 102 form the housing 110).

The movable pin assemblies of the examples of FIGS. 4A-4D and 5A-5D can be incorporated as upper movable pin assemblies of a bearing assembly to facilitate removal of the upper sealing element 152. This is illustrated in the example of the upper movable pin assemblies 120*a*' and 120*b*' of FIG. 1, having upper movable pins 162' and 162' similarly shaped and operated as described above regarding the lower movable pins 162*a* and 162*b*. Thus, the upper movable pins 162*a*' and 162*b*' can be actuated between unlocked and locked positions from the upper sealing element sleeve 146, via the perimeter channel 256 of the upper sealing element sleeve 146, to remove the upper sealing element sleeve 146 from the upper sealing element housing 138 to remove and to replace the upper sealing element 152. Accordingly, a fluid system (e.g., 172) could be operatively coupled to the upper locking pin assemblies 120*a*' and 120*b*' to effectuate such actuation, in a similar manner as described with reference to movable pins 162*a* and 162*b*.

Alternatively, the (rotatable) upper movable pins 162*a*' and 162*b*' of the upper locking pin assemblies 120*a*' and 120*b*' can be replaced with the configuration and function of the (translatable) movable pins 262*a* and 262*b*, as described regarding FIGS. 5A-5D (i.e., having elastic components that automatically bias the movable pins 262*a* and 26*b* in the locked position).

Figure 6:
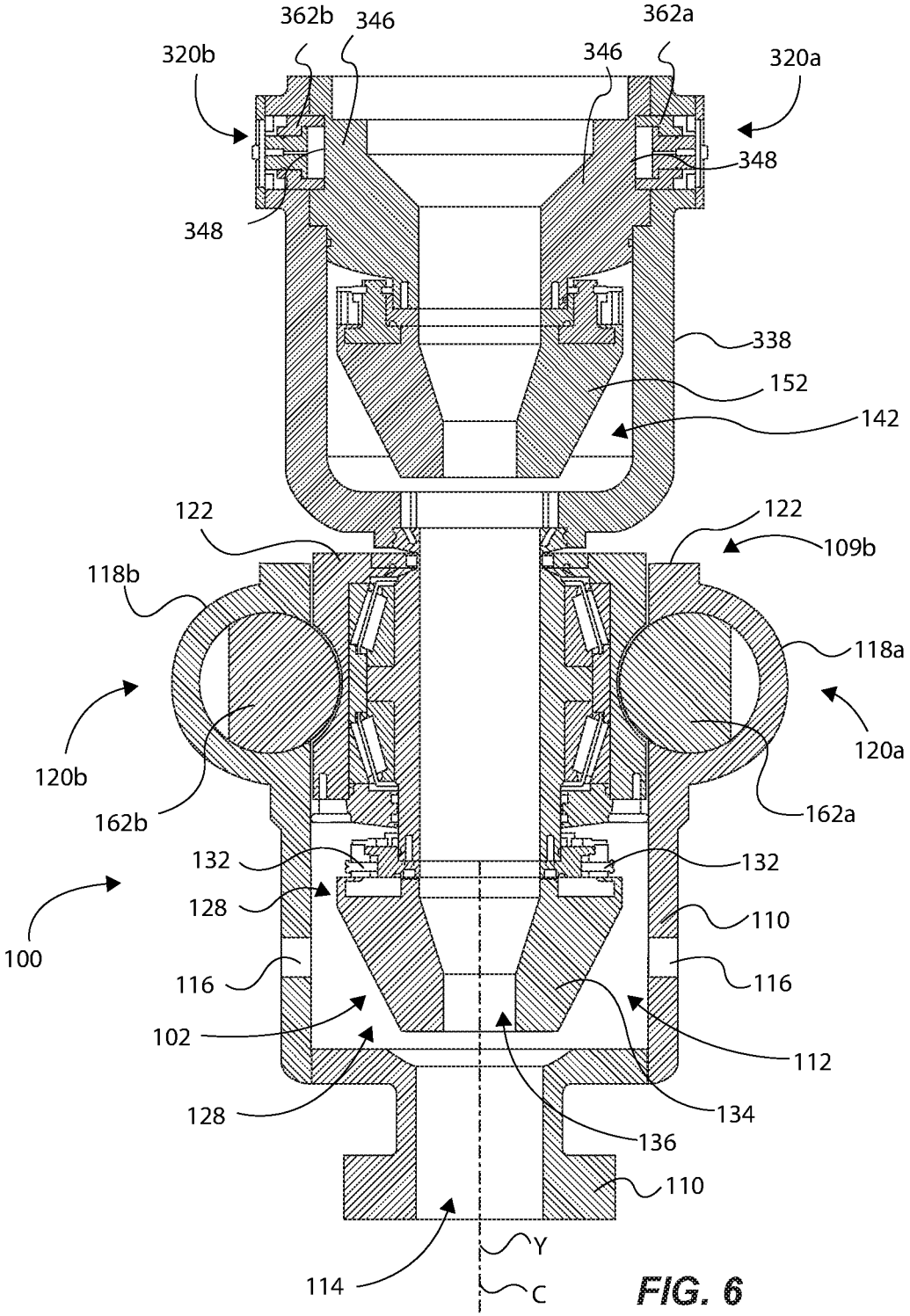
FIG. 6 is a cross-sectional view of a locking pin system, and a locking block system, of an RCD having a bearing assembly in accordance with an example of the present disclosure, similarly shown in FIG. 1, but FIG. 6 illustrating a locking block system operable to lock and unlock an upper sealing element sleeve to and from an upper sealing element housing of an upper sealing assembly.

FIG. 6 shows a variation of the system described regarding FIG. 1 in another example. Specifically, in this example the upper locking pin assemblies 120*a*' and 120*b*' of FIG. 1 can be replaced with at least two locking block assemblies 320*a* and 320*b* operable to lock and unlock an upper sealing element sleeve 346 to and from an upper sealing element housing 338 of a bearing assembly. The configuration and operation of the locking block assemblies 320*a* and 320*b* is further described in U.S. patent application Ser. No. 16/054,974, filed Aug. 3, 2018, which is incorporated by reference herein in its entirety. Thus, the upper sealing element sleeve 346 can comprise a perimeter channel 348 that interfaces with respective movable blocks 362*a* and 362*b* of the upper locking block assemblies 320*a* and 320*b* when in the locked position. The movable blocks 362*a* and 362*b* can be automatically biased to the locked position upon removing fluid pressure due to a stored spring force, similarly to the functionality of the system shown in FIGS. 5A-5D. The configuration of the movable blocks 362*a* and 362*b* is further detailed in the above-referenced related application incorporated herein.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A rotating control device (RCD) for use during a drilling operation, comprising:

a housing operable with a blowout preventer;

a bearing assembly operable to be received in the housing, and operable to receive a pipe of a drill string, the bearing assembly having an axis of rotation; and a plurality of locking pin assemblies supported by the housing, each locking pin assembly comprising a movable pin operable between a locked position that locks the bearing assembly to the housing, and an unlocked position that unlocks the bearing assembly from the housing, wherein each movable pin is movable about a respective axis oriented transverse and offset from the axis of rotation of the bearing assembly.

2. The RCD of claim 1, wherein each movable pin comprises a curved bearing interface surface configured to interface with a perimeter channel of a lower sealing element sleeve of the bearing assembly.

3. The RCD of claim 1, wherein the movable pins are configured to move to the unlocked position upon a fluid system actuating the movable pins.

4. The RCD of claim 1, wherein the housing comprises a first sub-housing and a second sub-housing, wherein each sub-housing comprises a chamber that rotatably or slidably supports the respective movable pin.

5. The RCD of claim 4, wherein each movable pin comprises a recessed portion, and wherein upon moving each movable pin to the unlocked position, the recessed portion is spatially separated from the lower sealing element sleeve to facilitate removal of the bearing assembly from the housing.

6. The RCD of claim 1, wherein the axis of each movable pin comprises an axis of translation, and wherein each movable pin is configured to translate along the axis of translation when actuated between the locked and unlocked positions.

7. The RCD of claim 6, wherein each locking pin assembly comprises at least one elastic component situated between the movable pin and the housing, the at least one elastic component configured to automatically bias the movable pin in the locked position.

8. The RCD of claim 7, wherein the housing defines a plurality of fluid pressure chambers each adjacent a respective movable pin, each fluid pressure chamber configured to retain pressurized fluid to maintain the respective movable pin in the unlocked position.

9. The RCD of claim 1, wherein the axis of each movable pin comprises an axis of rotation, wherein each movable pin is configured to rotate about the axis of rotation when actuated between the locked and unlocked positions.

10. A method for operating a rotating control device (RCD) for a drilling operation, comprising:

identifying an RCD coupled to a blowout preventer of a drill rig, the RCD comprising:

an RCD housing operable with the blowout preventer;

a bearing assembly receivable into the RCD housing, and operable to receive a pipe of a drill string, the bearing assembly having an axis of rotation; and a plurality of locking pin assemblies supported by the RCD housing, each locking pin assembly having a movable pin, wherein each movable pin is movable about a respective axis oriented transverse and offset from the axis of rotation of the bearing assembly;

applying an actuation force to the movable pins of the plurality of locking pin assemblies to move about the respective axis to be in an unlocked position;

inserting the bearing assembly into the RCD housing; and facilitating moving the movable pins about the respective axis from the unlocked position to a locked position, wherein the moveable pins interface with and engage the bearing assembly.

11. The method of claim 10, further comprising removing fluid pressure from fluid pressure chambers of the housing to cause each movable pin to automatically move to the locked position via a biasing force exerted to the movable pins via respective elastic components coupled to each movable pin.

12. The method of claim 10, further comprising actuating each movable pin to an unlocked position to facilitate removal of the bearing assembly from the RCD housing.

13. The method of claim 10, further comprising rotating each movable pin to an unlocked position to facilitate removal of the bearing assembly from the RCD housing.

* * * * *